US008215250B2

(12) United States Patent
Fukao

(10) Patent No.: US 8,215,250 B2
(45) Date of Patent: Jul. 10, 2012

(54) NEEDLE PLATE AND SEWING MACHINE PROVIDED THEREWITH

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 320 days.

(21) Appl. No.: 12/654,550

(22) Filed: Dec. 23, 2009

(65) Prior Publication Data

US 2010/0175601 A1 Jul. 15, 2010

(30) Foreign Application Priority Data

Jan. 9, 2009 (JP) ..... 2009-003468

(51) Int. Cl.
*D05B 73/12* (2006.01)
*D05B 73/00* (2006.01)

(52) U.S. Cl. ..... 112/260

(58) Field of Classification Search ..... 112/258, 112/217.4

See application file for complete search history.

(56) References Cited

U.S. PATENT DOCUMENTS

| | | | | |
|---|---|---|---|---|
| 1,262,114 | A * | 4/1918 | Smallbone | 112/260 |
| 3,011,463 | A * | 12/1961 | Fujita | 112/260 |
| 3,131,660 | A * | 5/1964 | Idomoto | 112/260 |
| 4,395,962 | A * | 8/1983 | Odermann | 112/260 |
| 4,646,665 | A * | 3/1987 | Jimenez et al. | 112/260 |
| 7,021,226 | B2 * | 4/2006 | Tseng | 112/302 |
| 7,194,969 | B2 | 3/2007 | Niizeki et al. | |
| 2006/0213410 | A1 | 9/2006 | Niizeki et al. | |
| 2010/0175601 | A1 | 7/2010 | Fukao | |

FOREIGN PATENT DOCUMENTS

| | | |
|---|---|---|
| JP | U-43-7770 | 4/1968 |
| JP | U-63-136590 | 9/1988 |
| JP | U-02-119175 | 9/1990 |
| JP | U-4-103879 | 9/1992 |
| JP | A-2000-237483 | 9/2000 |
| JP | A-2003-049812 | 2/2003 |
| JP | A-2006-238150 | 9/2006 |
| JP | A-2006-263072 | 10/2006 |
| JP | A-2008-207946 | 9/2008 |

(Continued)

OTHER PUBLICATIONS

U.S. Appl. No. 13/151,719, filed Jun. 2, 2011 in the name of Hiroaki Fukao.

(Continued)

*Primary Examiner* — Ismael Izaguirre
(74) *Attorney, Agent, or Firm* — Oliff & Berridge, PLC

(57) ABSTRACT

A needle plate for a sewing machine includes a first needle plate fixed to a sewing machine bed and formed with a needle hole through which a needle passes and a rectangular hole through which a feed dog appears, a second needle plate disposed in front of the first needle plate and detachably attached to the first needle plate, an engagement mechanism sliding the second needle plate rearward from a front side of the first needle plate, thereby engaging the second needle plate with the first needle plate, and a disengagement operating member located on the second needle plate so as to operate the engagement mechanism so that the second needle plate is disengaged from the first needle plate. The disengagement operating member is moved frontward from a rear side of the first needle plate thereby to disengage the second needle plate from the first needle plate.

4 Claims, 9 Drawing Sheets

FOREIGN PATENT DOCUMENTS

JP A-2010-158458 7/2010

OTHER PUBLICATIONS

Office Action issued in Japanese Patent Application No. 2009-003468 dated May 10, 2011 (with translation).

Notification of Reasons for Refusal for corresponding Japanese Patent Application No. 2009-003468, mailed on Nov. 24, 2010 (w/ English translation).

U.S. Appl. No. 13/310,198 in the name of Kenichi Mizuno et al., filed Dec. 2, 2011.

* cited by examiner

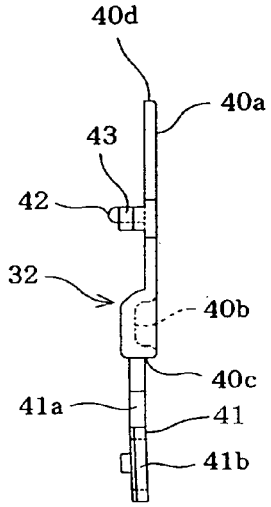
FIG. 5A
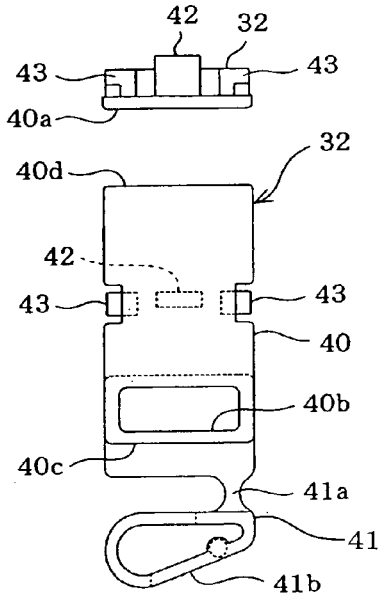
FIG. 5C
FIG. 5B
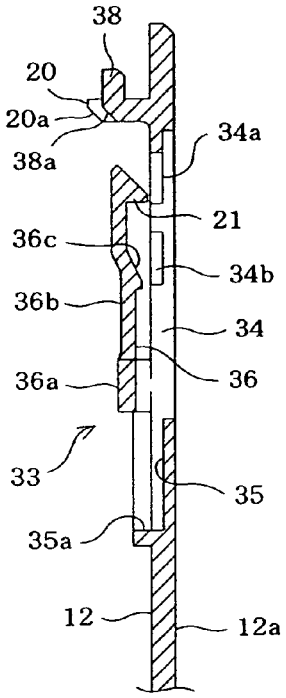
FIG. 6A
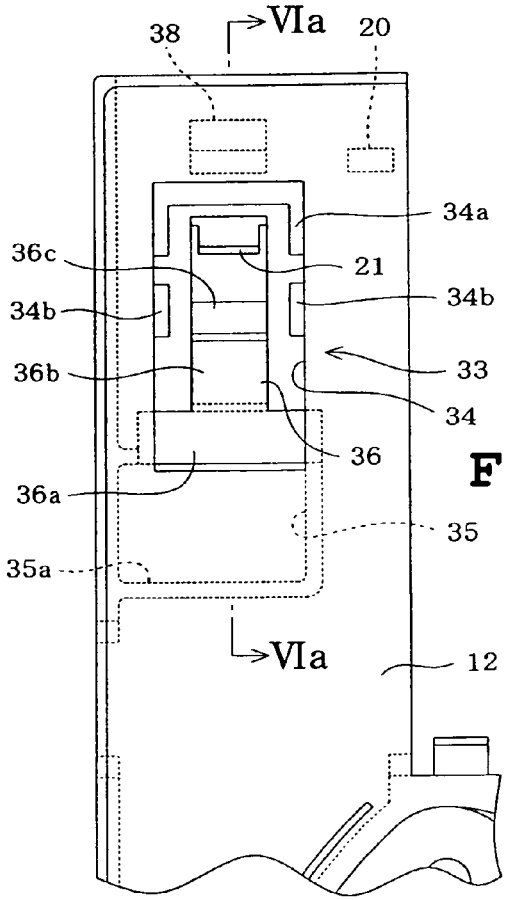
FIG. 6B

NEEDLE PLATE AND SEWING MACHINE PROVIDED THEREWITH

CROSS-REFERENCE TO RELATED APPLICATIONS

This application is based upon and claims the benefit of priority from the prior Japanese Patent Application No. 2009-3468 filed on Jan. 9, 2009, the entire contents of which are incorporated herein by reference.

BACKGROUND

1. Technical Field

The present disclosure relates to a needle plate having a first needle plate fixed to a sewing machine bed and a second needle plate detachably attached to the first needle plate, and a sewing machine provided with the needle plate.

2. Description of the Related Art

Conventional sewing machine have been provided with a needle plate screwed to an upper surface of the sewing machine bed (a bed portion) and having a needle hole through which a needle is penetrable and a rectangular hole through which a feed dog feeding a workpiece cloth is retractable. The sewing machine has also been provided with the horizontal hook mechanism disposed in the bed. In this type of sewing machine, when a bobbin thread is entangled with the horizontal hook mechanism or the periphery of the horizontal hook mechanism is cleaned, the needle plate is unscrewed thereby to be detached from the bed so that the horizontal hook mechanism and the periphery thereof are exposed. However, the needle plate necessitates positional adjustment relative to the needle, feed dog and the like when reattached to the bed. When the adjustment is not carried out accurately, there is a possibility that the needle or feed dog may collide with the needle plate.

In view of the above-described problem, the related art has proposed needle plates for a sewing machine which comprise a first needle plate having a needle hole and a rectangular hole and a second needle plate located above the first needle plate and a horizontal hook mechanism and in which only the second needle plate is detached from the bed so that necessary working can be carried out in the bed. For example, there has been proposed a needle plate provided with an engaging mechanism which is located on a back side thereof and engages the second needle plate with the first needle plate and a disengagement button operable at a surface side of the needle plate. The engaging mechanism includes a protrusion provided at the first needle plate side and a hole of leaf spring in engagement with the protrusion. When the disengagement button is depressed downward, the protrusion is adapted to be disengaged from the hole. As a result, only the second needle plate can be detached and the interior of the bed can be cleaned, and the first needle plate necessitating the positional adjustment need not be detached.

However, the detachment of the second needle plate from the first needle plate necessitates a first operation thrusting the disengagement button downward against an elastic force of the leaf spring of the engagement mechanism and a second operation pulling the second needle plate frontward while the disengagement button is kept depressed. More specifically, directions of operation forces effective in the first and second operations are opposite to each other. Accordingly, the second needle plate is difficult to detach and a two-staged operation is troublesome.

SUMMARY

Therefore, an object of the disclosure is to provide a needle plate in which the second needle plate can be attached to and detached from the first needle plate exceedingly easily and a sewing machine provided with the needle plate.

The present disclosure provides a needle plate disposed on an upper surface of a sewing machine bed of a sewing machine having a horizontal hook mechanism inside the sewing machine bed, the needle plate comprising a first needle plate fixed to the sewing machine bed and formed with a needle hole through which a needle is configured to pass and a rectangular hole through which a feed dog that is configured to feed a workpiece cloth appears; a second needle plate disposed in front of the first needle plate and above the horizontal hook mechanism, the second needle plate being detachably attached to the first needle plate; an engagement mechanism sliding the second needle plate rearward from a front side of the first needle plate, thereby engaging the second needle plate with the first needle plate; and a disengagement operating member provided on the second needle plate, the disengagement operating member being configured to cancel the engagement by the engagement mechanism, the disengagement operating member being moved frontward from a rear side of the first needle plate thereby to cancel the engagement by the engagement mechanism, wherein the engagement mechanism includes an engagement hole formed in the first needle plate, and an elastically deformable engaging member having a proximal end fixed to the second needle plate and a free end formed with an engagement claw engageable with the engagement hole, and the engagement hole and the engagement claw are engaged with each other by an elastic force of the engaging member.

In the above-described construction, the second needle plate is caused to engage with the first needle plate when slid rearward from the front side of the first needle plate. The disengagement operating member is operated so as to be moved frontward from the rear side of the first needle plate, whereby the second needle plate is disengaged from the first needle plate. Accordingly, the second needle plate can easily be attached to the first needle plate by sliding the second needle plate. Moreover, in detaching the second needle plate, a detaching direction corresponds with an operating direction of the disengagement operating member. Accordingly, since the disengagement operating member is slid frontward together with the second needle plate, the second needle plate can be detached from the first needle plate only by a primary operation of the disengagement operating member. Consequently, the second needle plate can be attached to and detached from the first needle plate exceedingly easily.

BRIEF DESCRIPTION OF THE DRAWINGS

In the accompanying drawings:

FIGS. 5A, 5B and 5C are enlarged side, plan and rear views of a disengaging member respectively;

FIG. 6A is a sectional view taken along line VIa-VIa in FIG. 6B;

FIG. 6B is an enlarged plan view of an attaching portion for a disengaging member and the periphery thereof;

DETAILED DESCRIPTION

Figure 1:
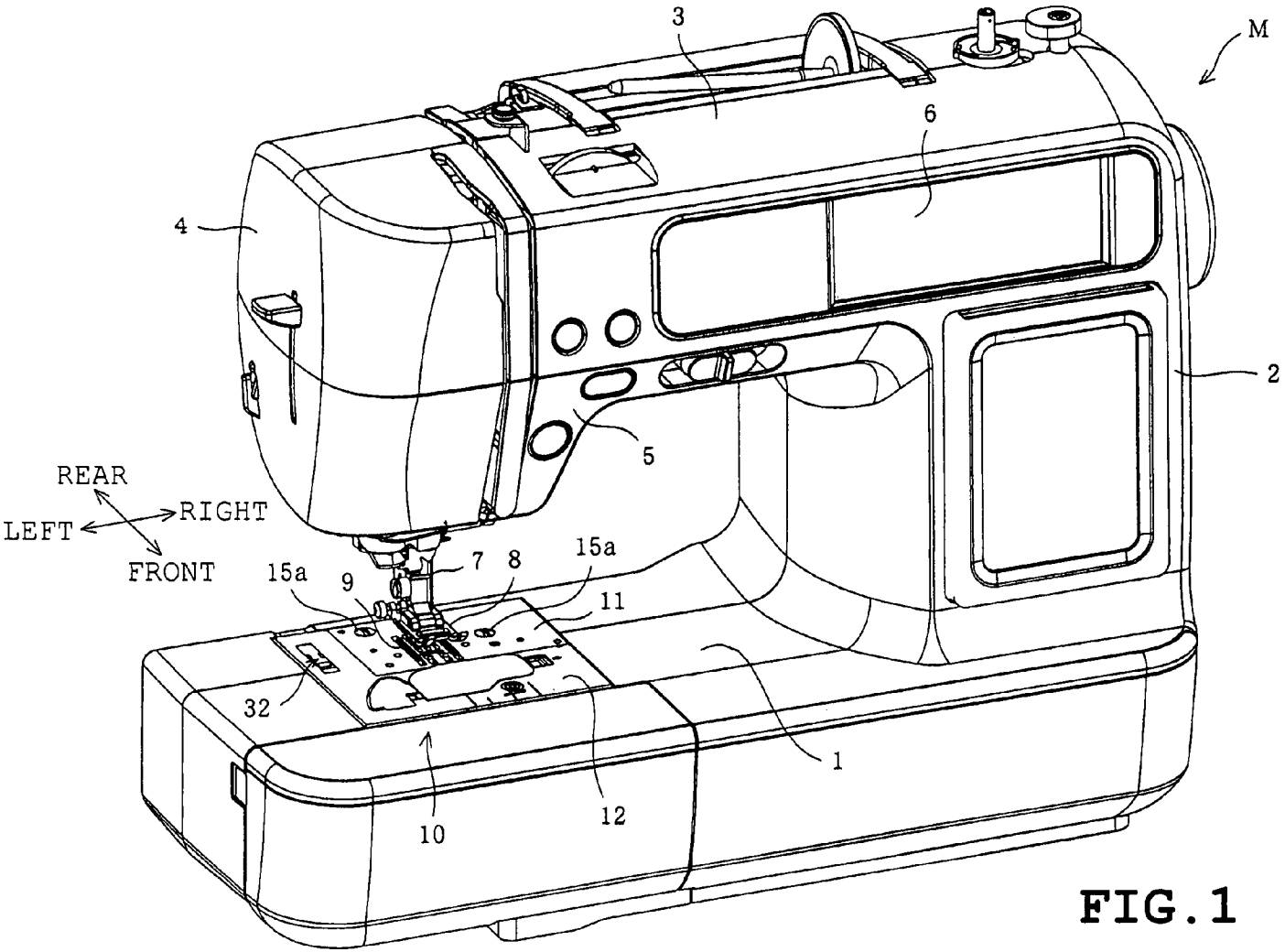
FIG. 1 is a perspective view of a sewing machine provided with a needle plate in accordance with one embodiment of the present invention, showing the second needle plate being attached to the first needle plate.

A first embodiment of the present disclosure will be described with reference to the accompanying drawings. Referring to FIG. 1, an entire sewing machine M is shown. In the following description, an operator is located in front of the sewing machine M. The sewing machine M includes a sewing bed 1, a sewing pillar 2 extending upward from a right end of the bed 1, a sewing arm 3 extending leftward from an upper end of the pillar 2 opposite the sewing machine bed 1 and a sewing head 4 mounted on a left end of the arm 3. The arm 3 has a front on which various operation switches 5 are provided, and a horizontal crystal liquid display 6 is provided on a front of the pillar 2.

A sewing machine main shaft (not shown) is mounted inside the arm 3 so as to extend in a horizontal direction, and a sewing machine motor (not shown) is also provided inside the arm 3 for rotating the main shaft. A needle bar is provided in the head 4 although not shown in detail. The needle bar has a lower end to which a needle 7 is attached. A cloth presser 8 pressing a workpiece cloth (not shown) from above is disposed near the needle 7. Inside the arm 3 are further provided a needle bar drive mechanism which moves the needle bar upward and downward based on rotation of the main shaft, a needle bar swing mechanism which swings the needle bar in a direction (horizontal direction) perpendicular to a cloth feed direction, a needle thread take-up drive mechanism which moves a needle thread take-up upward and downward in synchronization with the movement of the needle bar, and the like.

A needle plate 10 is provided on an upper surface of the bed 1. Inside the bed 1 are provided a cloth feed mechanism which is located below the needle plate 10 to move a feed dog 9 (shown only in FIG. 1) vertically and horizontally, a horizontal hook mechanism which houses a bobbin and forms stitches in cooperation with the needle 7, and the like.

Figure 2:
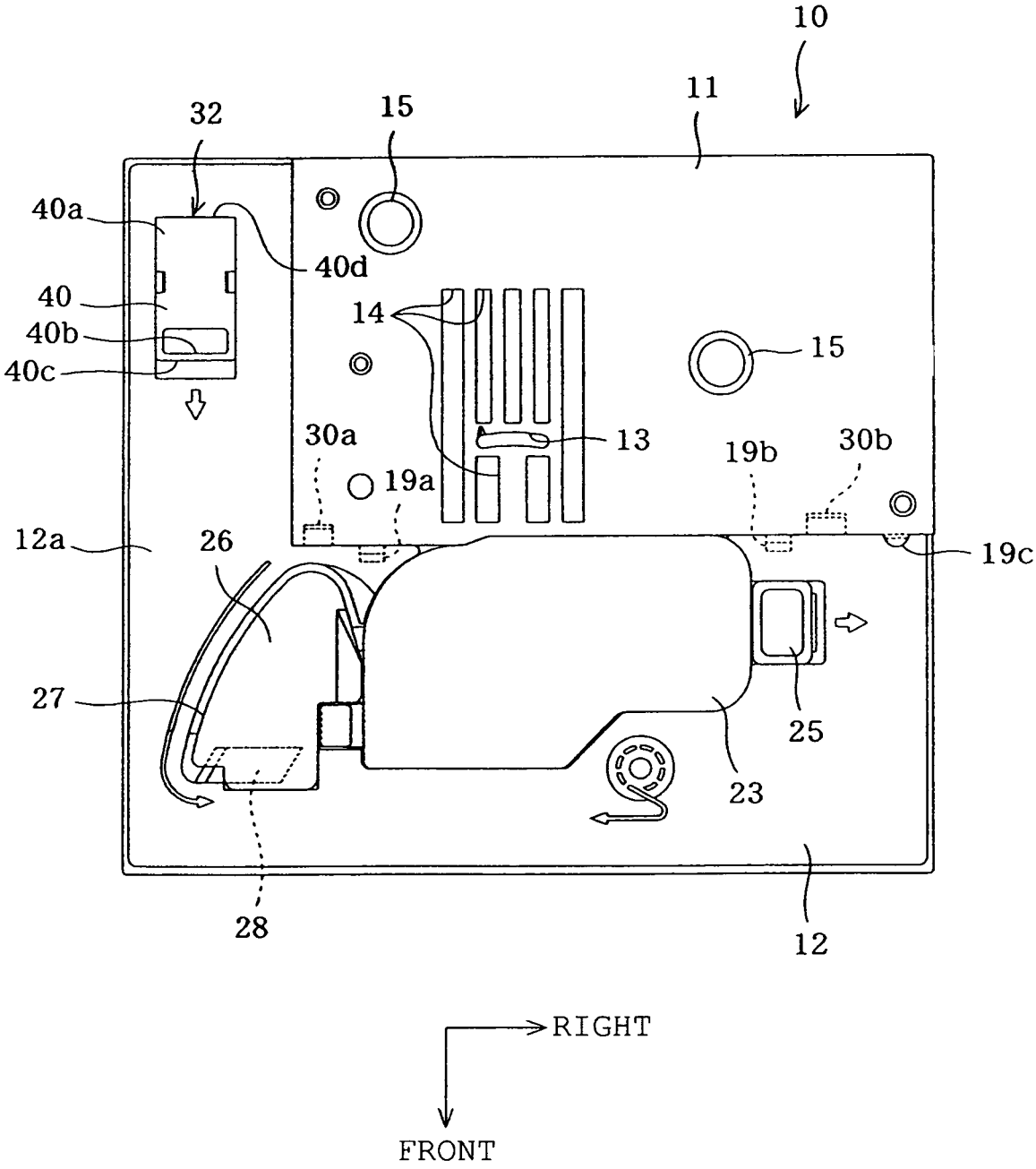
FIG. 2 is a plan view of the needle plate, showing the state where the second needle plate is attached to the first needle plate.
Figure 3:
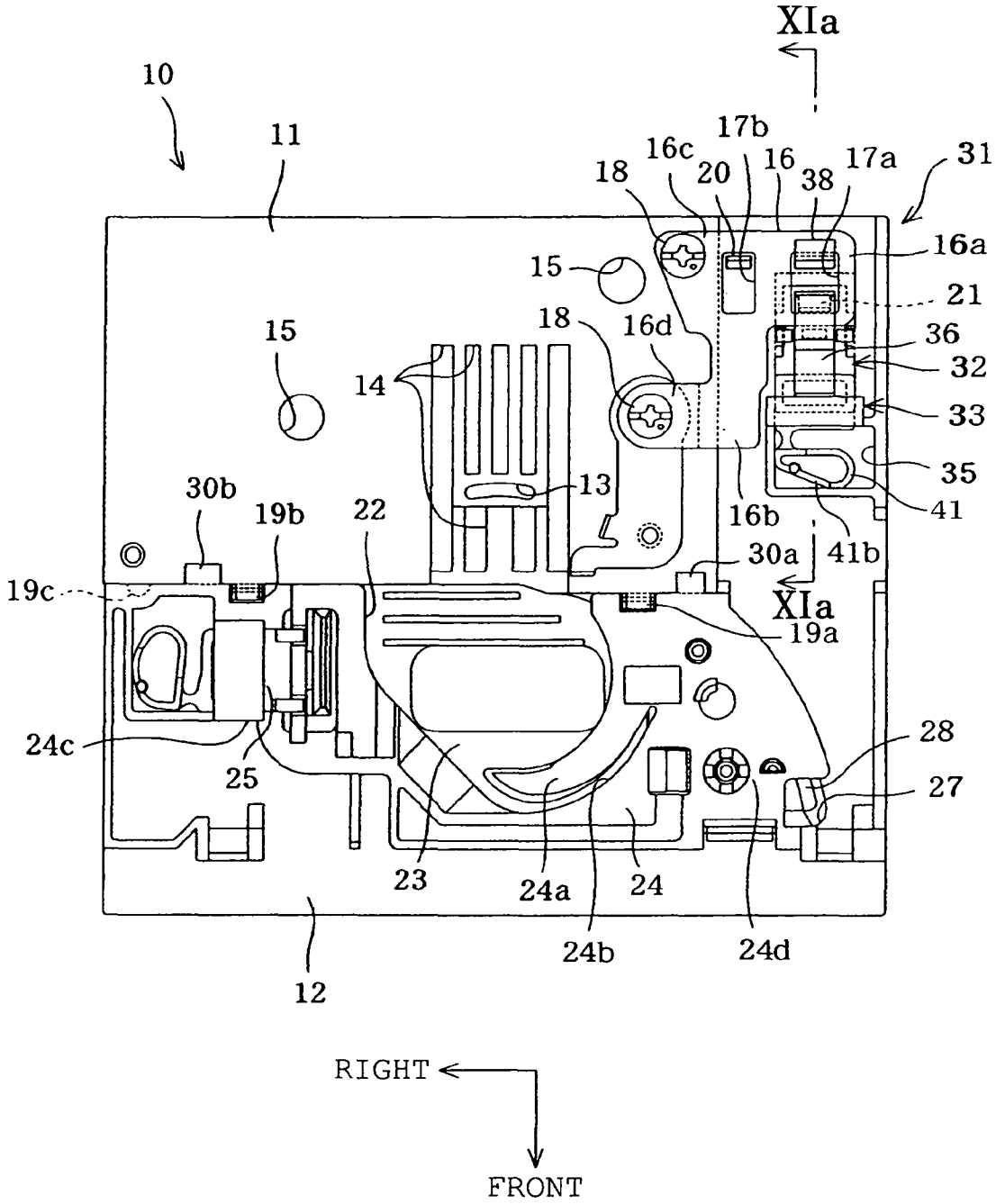
FIG. 3 is a bottom view of the needle plate.
Figure 4:
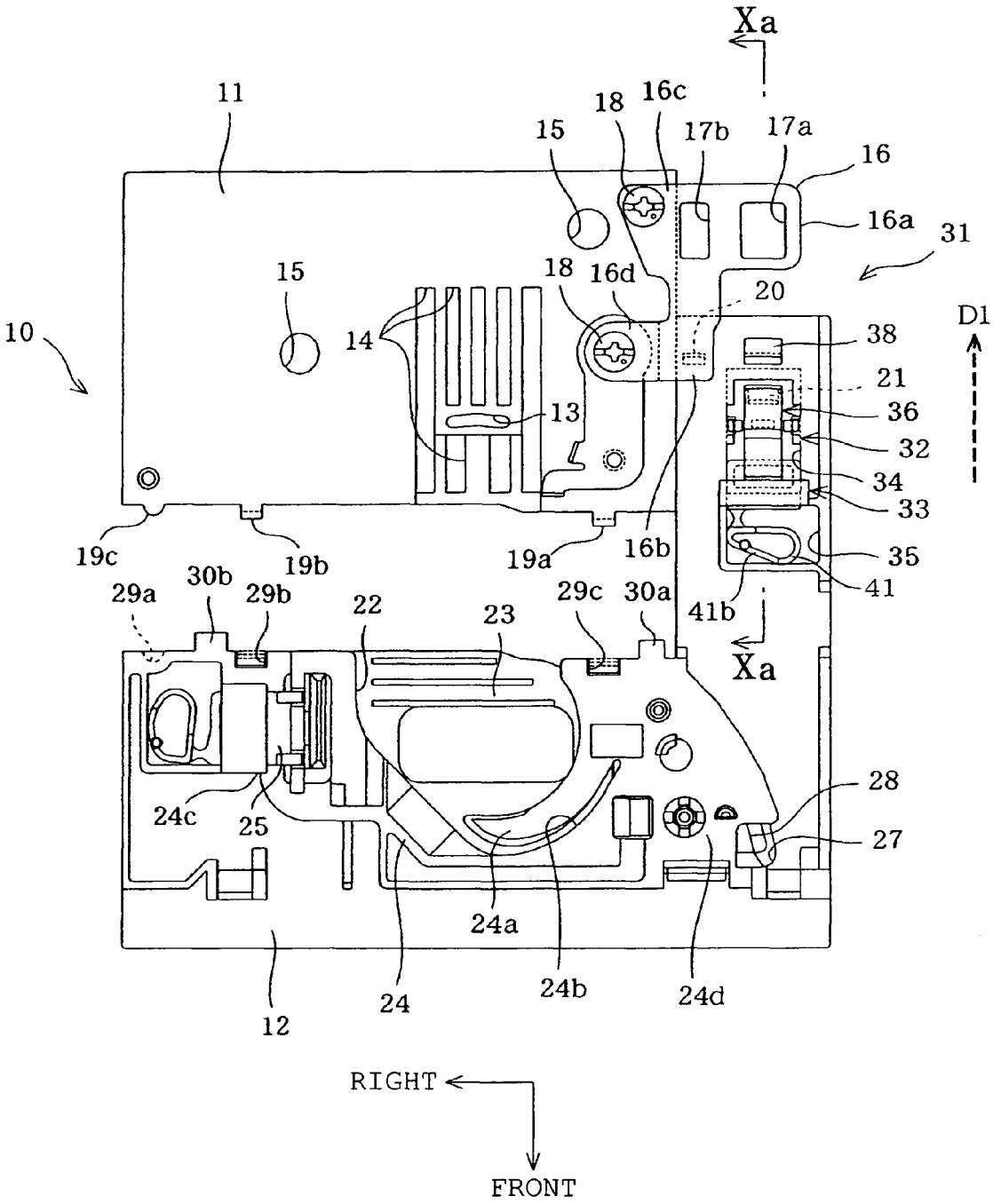
FIG. 4 is also a bottom view of the needle plate, showing the state where the second needle plate is being attached to the first needle plate.

The needle plate 10 will now be described in more detail with reference to FIGS. 2 to 4 as well as FIG. 1. The entire needle plate 10 is formed into a generally rectangular plate shape and includes a first needle plate 11 fixed to the bed 1 and a second needle plate 12 detachably attached to the first needle plate 11, as shown in FIGS. 2 to 4. The first needle plate 11 is made from a metal and formed into a rectangular plate shape. The first needle plate 11 has a needle hole 13 through which the needle 7 passes and a plurality of rectangular holes 14 through which the feed dog 9 feeding the workpiece cloth appears (seven rectangular holes 14, for example). The needle hole 13 is elongate sideways and is curved. The rectangular holes 14 each extend in the front-back direction and are formed into elongate linear shapes. The rectangular holes 14 are formed so as to surround the needle hole 13. The first needle plate 11 also has two through holes 15. Two flat head screws 15*a* (shown only in FIG. 1) are inserted through the through holes 15 respectively, whereby the first needle plate 11 is fixed to the upper surface of the bed 1.

The first needle plate 11 has a back side provided with an engagement supporting member 16 located on a left rear (right rear as viewed in FIGS. 3 and 4) corner. The engagement supporting member 16 is made of a metal and generally formed into a crank shape. The engagement supporting member 16 has a main portion 16*a* formed with an engagement hole 17*a* and a through hole 17*b*, a supporting portion 16*b* extending frontward from a right half of the main portion 16*a*, and two attaching portions 16*c* and 16*d* extending from the main portion 16*a* and the supporting portion 16*b* to the first needle plate 11 side respectively. The engagement supporting member 16 is fixed to the first needle plate 11 at the attaching portions 16*c* and 16*d* by respective small screws 18. The main portion 16*a* extends leftward from a left end of the first needle plate 11 (to the second needle plate 12 side). An engagement claw 21 and an auxiliary engagement portion 38 (see FIGS. 4 and 6A respectively) are adapted to be engaged with the left engagement hole 17*a* of the main portion 16*a*, and a slide protrusion 20 is adapted to be inserted through the right through hole 17*b*, as will be described in detail later. The first needle plate 11 has a front edge provided with a plurality of (three, for example) forwardly protruding engagement protrusions 19*a* to 19*c* spaced from each other sideways.

On the other hand, the second needle plate 12 is made from a synthetic resin, for example and is formed into a generally L-shaped plate extending along the front and left edges of the first needle plate 11. As shown in FIG. 3, the second needle plate 12 is formed with a bobbin slot 22 which is located at the central rear in a horizontal direction and through which the bobbin is put into a horizontal hook mechanism, as shown in FIG. 3. The bobbin slot 22 is formed so as to be notched frontward into an embayed shape. A clear needle plate cover 23 made from a synthetic resin is detachably attached to the second needle plate 12 so as to cover the bobbin slot 22 from above. A bottom wall 24 is formed on a peripheral edge of the bobbin slot 22 of the second needle plate 12 as shown in FIGS. 2 and 3. The bottom wall 24 is formed by hollowing the peripheral edge of the bobbin slot 22 by a thickness of the needle plate cover 23 so as to be sunk from the upper surface of the second needle plate 12. The bottom wall 24 has a generally crescentic thread guide 24*a* which is formed integrally therewith and guides a bobbin thread from the bobbin, leftward. An arc-shaped first guide groove 24*b* is formed in the bottom wall 24 so as to be located in front of the thread guide 24*a*. The first guide groove 24*b* communicates with the bobbin slot 22.

Further referring to FIGS. 2 and 3, the bottom wall 24 of the second needle plate 12 is formed with a holder mounting portion 24*c* located on the right of the needle plate cover 23. An elastic holder 25 is mounted on the holder mounting portion 24*c* so as to depress the needle plate cover 23 leftward. The holder 25 holds the needle plate cover 23 by the elastic force thereof so that the needle plate cover 23 is undetachable. When operated to be moved rightward against the elastic force, the holder 25 is departed from the needle plate cover 23, whereby the needle plate cover 23 is allowed to be detached. The bobbin slot 22 is opened when the needle plate cover 23 has been detached from the second needle plate 12 by the operation of the holder 25. The bobbin is adapted to be attached through the bobbin slot 22 to the horizontal hook mechanism.

The bottom wall 24 of the second needle plate 12 is further formed with a cover attachment portion 24*d* located to the left of the needle plate cover 23. A cover 26 (see FIG. 2) made from a synthetic resin is attached to the cover attachment portion 24*d*. A gap is defined between the cover attachment portion 24*d* and a peripheral edge of the cover 26. The cover attachment portion 24*d* is formed with a second guide groove 27 which communicates with a left end of the first guide groove 26 below the cover 26. A cutting blade 28 is mounted on a lower end of the cover 26 to cut a bobbin thread at a front end of the second guide groove 27.

A plurality of engagement recesses 29*a* to 29*c* are formed in a rear surface of the second needle plate 12 so as to face the front edge of the first needle plate 11 and so as to be engageable with engagement protrusions 19*a* to 19*c* respectively. A pair of right and left support protrusions 30*a* and 30*b* are also formed on the rear surface of the second needle plate 12. The support protrusions 30*a* and 30*b* lock the front edge of the first needle plate 11 at the lower surface side. The second needle plate 12 is held on the first needle plate by the engagement of the support protrusions 30*a* and 30*b* with the front edge of the first needle plate 11 and the engagement of the engagement protrusions 19*a* to 19*c* with the engagement recesses 29*a* to 29*c* respectively while being positioned in the vertical and horizontal directions.

The needle plate 10 is provided with an engagement mechanism 31 which slides the second needle plate 12 rearward from a front side of the first needle plate 11, thereby engaging the second needle plate 12 with the first needle plate 11. The needle plate 10 is also provided with a disengagement operating member 32 which operates the engagement mechanism 31 so that the second needle plate 12 is disengaged from the first needle plate 11.

The engagement mechanism 31 and the disengagement operating member 32 will now be described in detail with further reference to FIGS. 5A to 8B. The second needle plate 12 has a rear end on which an operating member mounting portion 33 is integrally formed for mounting the disengagement operating member 32 so that the disengagement operating member 32 is movable in the front-back direction. The operating member mounting portion 33 includes an upper surface opening 34 which is rectangular in planar view and a lower surface housing portion 35 which is continuous with a front part of the upper surface opening 34 and houses a front part of the disengagement operating member 32 at the lower surface side of the second needle plate 12. The upper surface opening 34 has a peripheral edge formed with a support rib 34*a* which is located at a rear end thereof and supports the lower surface of the disengagement operating member 32. The peripheral edge of the upper surface opening 34 is also formed with a pair of right and left guide ribs 34*b* which are located in the middle of the opening 34 in the front-back direction and guides the disengagement operating member 32 in the front-back direction.

An inverted T-shaped engaging member 36 is provided on the lower surface side of the upper surface opening 34. The engaging member 36 extends along the opening 34. The engaging member 36 is formed integrally on the second needle plate 12 (more specifically, integral molding by injection molding) and has a proximal end 36*a* serving as a fixed end fixed to the second needle plate 12 and an arm 36*b* extending rearward from the proximal end 36*a*. The arm 36*b* has a distal (free) end formed with an engagement claw 21 which is engageable with the engagement hole 17*a* of the engagement supporting member 16. The arm 36*b* has an inclined portion 36*c* which is formed in the middle thereof so as to be inclined so that the proximal end 36*a* (the front side) is located higher. The free end of the engaging member 36 is elastically deformable downward to a position (see FIG. 11B) where the engagement claw 21 is disengaged from the engagement hole 17*a*, by the flexibility of the synthetic resin material.

The rear end of the second needle plate 12 is provided with an auxiliary engagement portion 38 which is located immediately behind the upper surface opening 34 and is engageable with the engagement hole 17*a*. The rear end of the second needle plate 12 is also provided with a slide protrusion 20 insertable through the through hole 17*b*. The auxiliary engagement portion 38 and the slide protrusion 20 are arranged sideways. The auxiliary engagement portion 38 is generally formed into an L-shape and engages both engagement claw 21 and engagement hole 17*a*. The slide protrusion 20 protrudes lower than the auxiliary engagement portion 38. Accordingly, when the second needle plate 12 is attached to the first needle plate 11 rearward, the slide protrusion 20 is slid on the supporting portion 16*b* of the engagement supporting member 16, whereupon the second needle plate 12 is smoothly slid. The auxiliary engagement portion 38 and the slide protrusion 20 have front corners formed into chamfered surfaces 38*a* and 20*a* respectively. Accordingly, when detached from the first needle plate 11 frontward, the second needle plate 12 is smoothly dropped out of the engagement hole 17*a* and the through hole 17*b*. The above-described engagement supporting member 16 having the engagement hole 17*a* and the through hole 17*b*, the engaging member 36 and the auxiliary engaging member 38 constitute an engagement mechanism 31.

The disengagement operating member 32 is made from a synthetic resin, for example and has an operation portion 40 formed into a generally rectangular shape in planar view, an annular portion 41*b* provided on a front portion of the operation portion 40 with a connecting portion 41*a* being interposed therebetween, and depressing portion 42 protruding downward from a central part of the operation portion 40, all of which are formed integrally with the disengagement operating member 32.

Figure 9A:
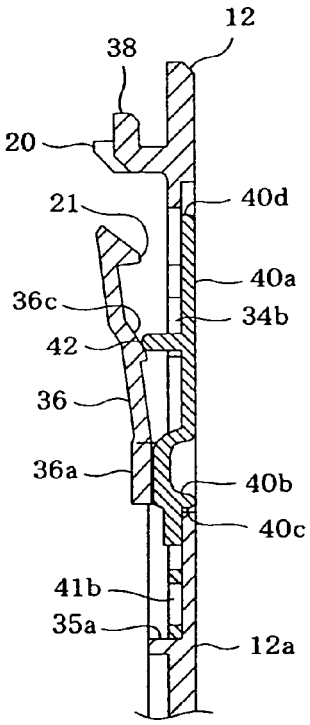
FIGS. 9A and 9B are views similar to FIGS. 8A and 8B, showing the state where the operating portion has been moved to a front position, respectively.
Figure 9B:
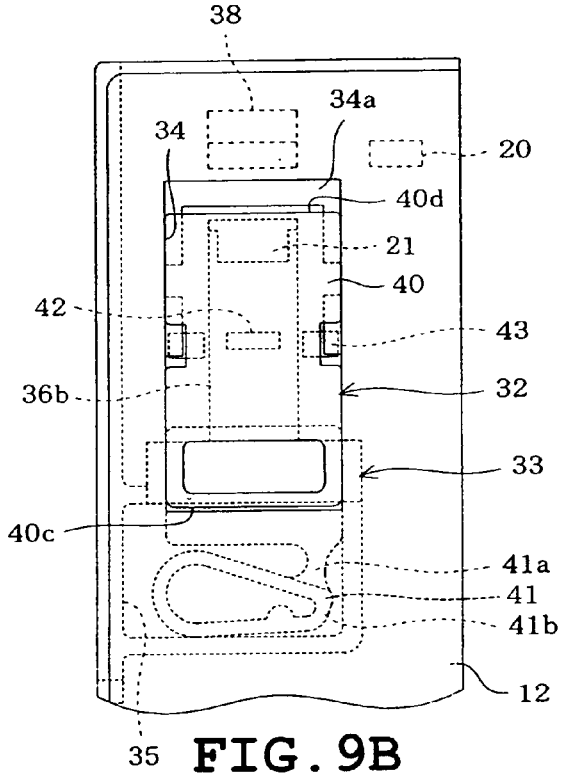

The operating member 40 is disposed in the upper surface opening 34 of the operating member mounting portion 33 so that an upper surface 40*a* of the operating member 40 is coplanar with the upper surface 12*a* of the second needle plate 12. A finger hook 40*b* is formed on a front part of the operation portion 40 so as to be depressed downward. The finger hook 40*b* is operated by an operator's finger. The operation portion 40 also includes a lowered portion 40*c* which is lowered from the upper surface 40*a* thereof and located immediately in front of the finger hook 40*b*. As the result of the above-described construction, the operation portion 40 is movable between a front position (see FIGS. 9A and 9B) where the lowered portion 40*c* abuts against the front edge of the upper surface opening 34 and a rear position (see FIGS. 8A and 8B) where a rear end 40*d* of the operation portion 40 abuts against the rear edge of the upper surface opening 34.

The connecting portion 41*a* and the annular portion 41*b* are located so as to be put into the lower surface housing portion 35 of the operating member mounting portion 33. The connecting portion 41*a* and the annular portion 41*b* elastically urge the operation portion 40 to the rear position by the flexibility of the synthetic resin, and the operation portion 40 is constructed as an elastic deforming portion 41 which elastically deforms with movement to the front position.

The depressing portion 42 is a downward rib provided in the operation portion 40 so as to be opposed to the inclined portion 36*c* of the engaging member 36. The depressing portion 42 depresses the inclined portion 36*c* against the elastic force of the engaging member 36 with the movement of the operation portion 40 to the front position, so that the engagement claw 21 is disengaged from the engagement hole 17*a*. Furthermore, a pair of guided portions 43 guided by the paired guide ribs 34*b* are formed on the right and left sides of the operation portion 40. The guided portions 43 are guided by the guide ribs 34*b* thereby to allow only the movement of the operation portion 40 in the front-back direction. The guided portions 43 also prevents the operation portion 40 from dropping out of the upper surface opening 34 by a counter force (the elastic force of the engaging member 36) during operation of the operation portion 40.

Figure 7A:
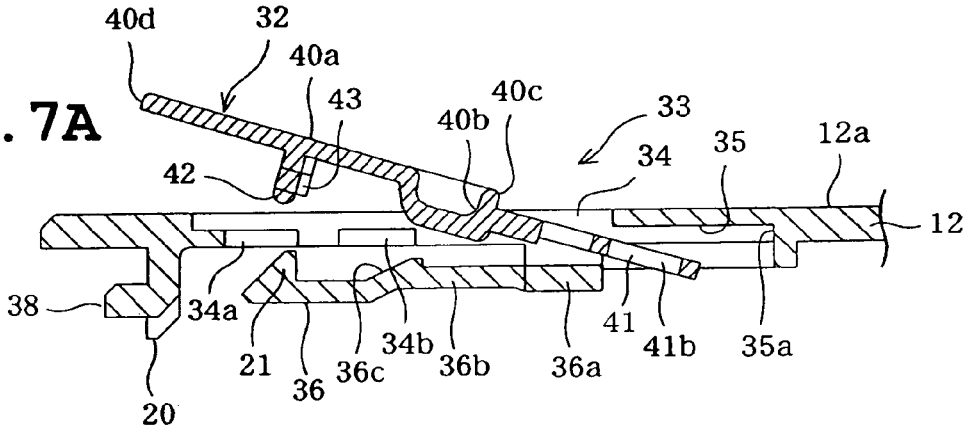
FIGS. 7A and 7B are longitudinal side sections of the attaching portion in the state where the disengaging member is being attached to the attaching portion.
Figure 7B:
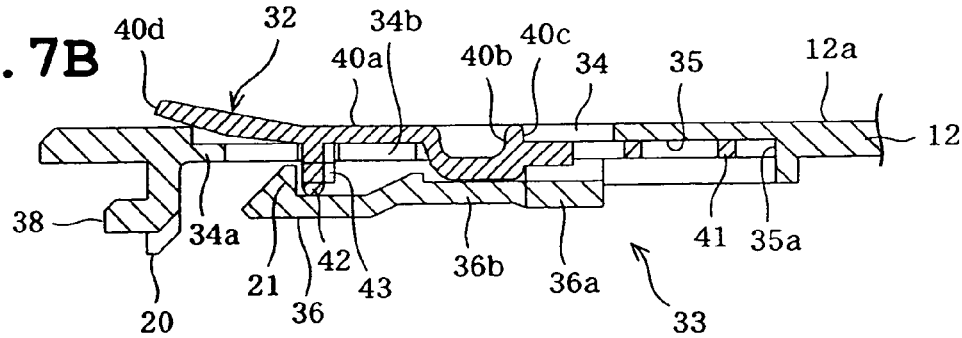
Figure 7B:
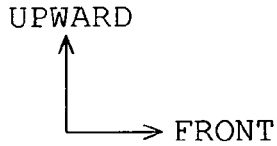
Figure 8A:
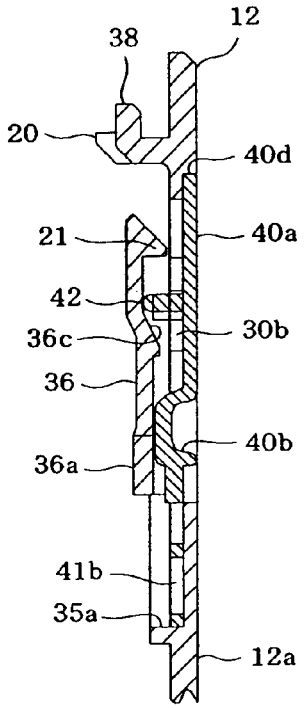
FIG. 8A is a sectional view taken along line VIIIa-VIIIa in FIG. 8B.
Figure 8B:
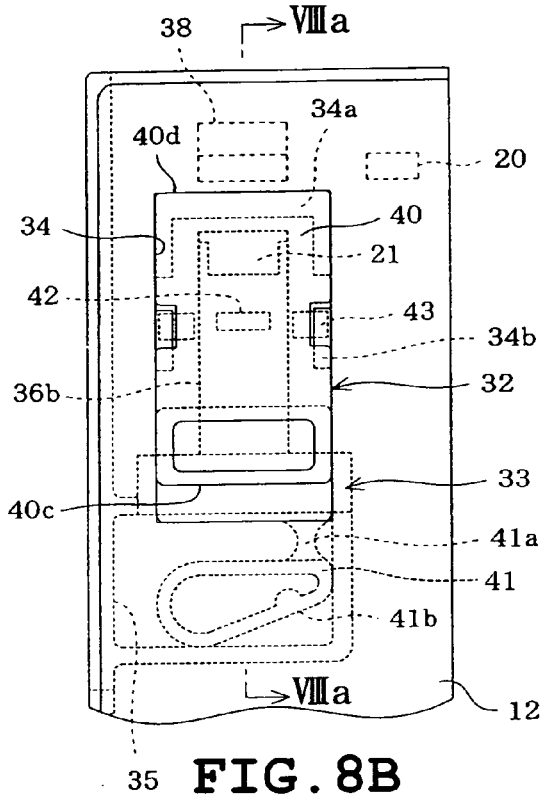
FIG. 8B is an enlarged plan view of the attaching portion, showing the state where an operating portion has been moved to a rear position.

The disengagement operating member 32 is assembled to the operating member mounting portion 33 from above as shown in FIG. 7A. In the assembly, the disengagement operating member 32 is merely inserted into the operating member mounting portion 33 frontward from the back. More specifically, the annular portion 41*b* of the disengagement operating member 32 is inserted through the upper surface opening 34 to the lower surface housing portion 35 side so that the guided portion 43 of the disengagement operating member 32 is moved frontward so as to be slid below the guide ribs 34*b* of the operating member mounting portion 33. In this case, the disengagement operating member 32 is inserted while the guided portion 43 thereof is being guided frontward by the guide ribs 34. Furthermore, the disengagement operating member 32 is fitted into the upper surface opening 34 while the rear end 40*d* thereof is elastically deformed so as to be flexed upward, as shown in FIG. 7B. When the whole operation portion 40 has been put into the upper surface opening 34, the annular portion 41*b* abuts against the inner wall surface 35*a* of the lower surface housing portion 35 thereby to be locked so as to be immovable frontward. As a result, the operation portion 40 is elastically urged to the rear position with the connecting portion 41*a*, whereupon the assembly is completed (see FIG. 8A).

Figure 10A:
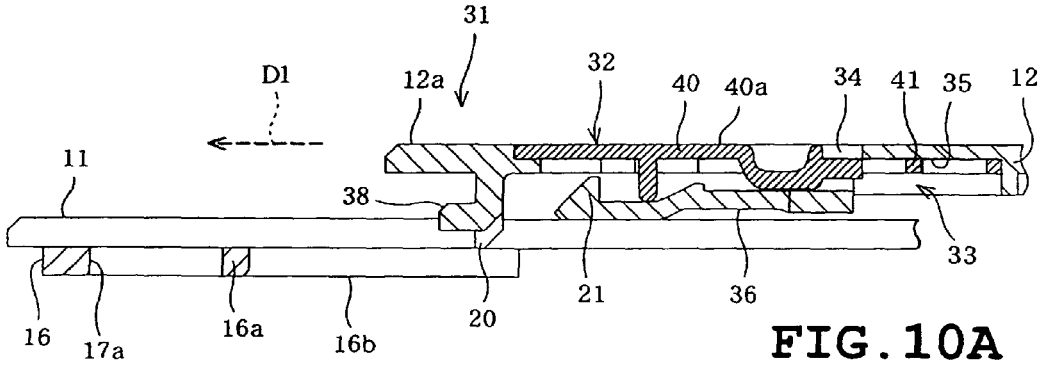
FIG. 10A is a view taken along line Xa-Xa in FIG. 4.
Figure 10B:
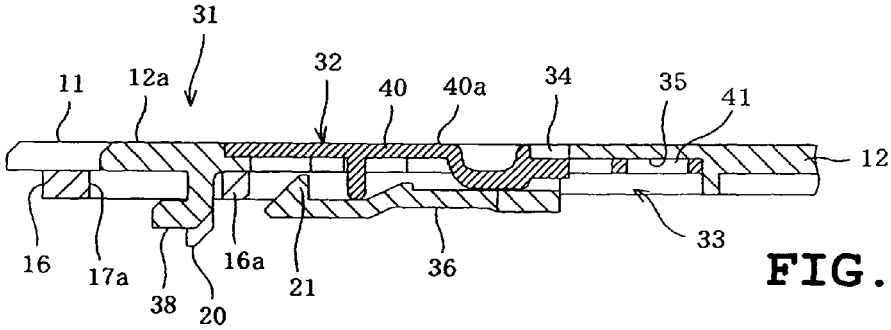
FIGS. 10B and 10C are longitudinal side sections of an engagement mechanism, explaining the process of attaching the second needle plate to the first needle plate, together with FIG. 10A.
Figure 10C:
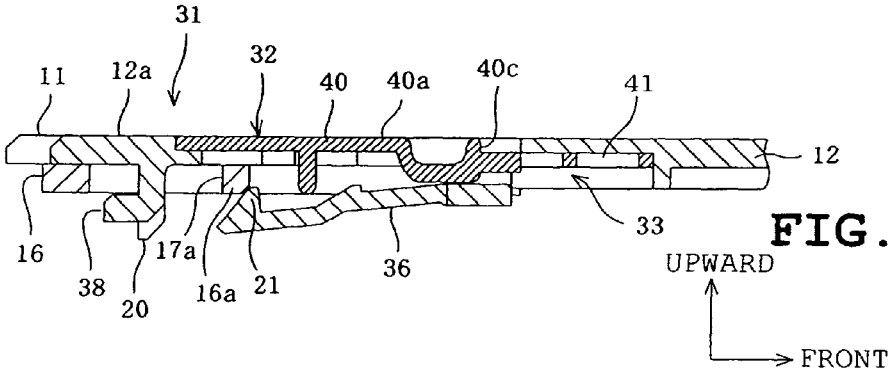

The working of the needle plate 10 will now be described with further reference to FIGS. 10A to 11C. The attachment of the second needle plate 12 to the first needle plate 11 is carried out while the first needle plate 12 is fixed to the bed 1. More specifically, the second needle plate 12 is slid rearward from the front side of the first needle plate 11 in the direction of arrow D1 as shown in FIGS. 4 and 10A. In this case, the slide protrusion 20 is brought into sliding contact with the supporting portion 16*b* of the engagement supporting member 16 in the rear of the second needle plate 12 from above, so that the sliding movement can smoothly be executed without collision of the auxiliary engagement portion 38 of the second needle plate 12 and the like against the engagement supporting member 16 of the first needle plate 11 (so as not to be caught by each other).

The auxiliary engagement portion 38 and the slide protrusion 20 of the second needle plate 12 fall into the engagement hole 17*a* and the through hole 17*b* during the sliding movement respectively, whereupon the second needle plate 12 is coplanar with the first needle plate 11. Subsequently, the engagement claw 21 abuts against the main portion 16*a* of the engagement supporting member 16 (see FIG. 10C). In this case, the free end of the engaging member 36 is elastically deformed so as to be flexed downward and thereafter, the engagement claw 21 reaches and is fitted into the engagement hole 17*a*. The engaging member 36 returns to the original state with the fitting of the engagement claw 21 into the engagement hole 17*a* (see FIG. 11A). As a result, both auxiliary engagement portion 38 and engagement claw 21 are engaged with the engagement hole 17*a* of the engagement supporting member 16 such that the second needle plate 12 is locked so as to be immovable, whereby the second needle plate 12 is attached to the first needle plate 11. Furthermore, in this case, the support protrusions 30*a* and 30*b* of the second needle plate 12 are engaged with the front edge of the first needle plate 11, and the engagement protrusions 19*a* to 19*c* are engaged with the engagement recesses 29*a* to 29*c* respectively. As a result, the second needle plate 12 is held in the state where the second needle plate 12 is positioned vertically and horizontally relative to the first needle plate 11.

Figure 11A:
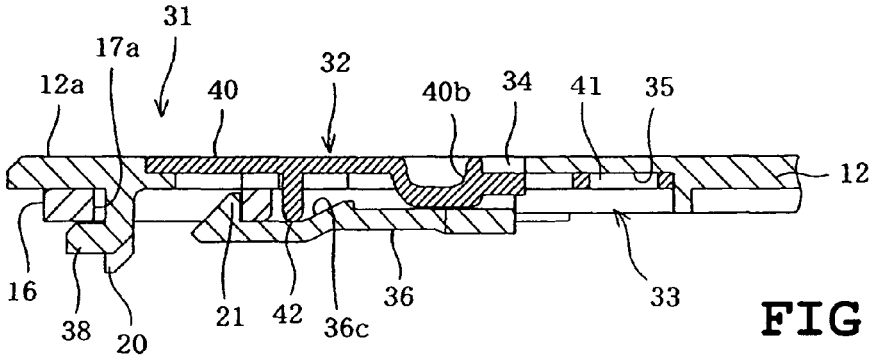
FIG. 11A is a view taken along line XIa-XIa in FIG. 3.
Figure 11B:
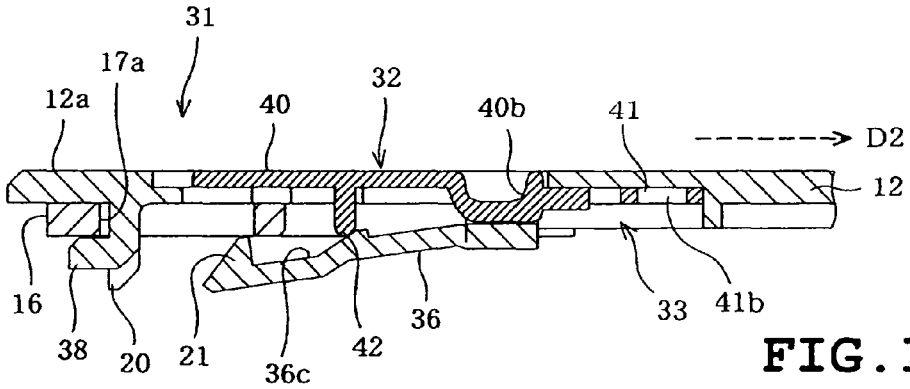
FIGS. 11B and 11C are longitudinal side sections of the engagement mechanism, explaining the process of detaching the second needle plate from the first needle plate, together with FIG. 11A.
Figure 11C:
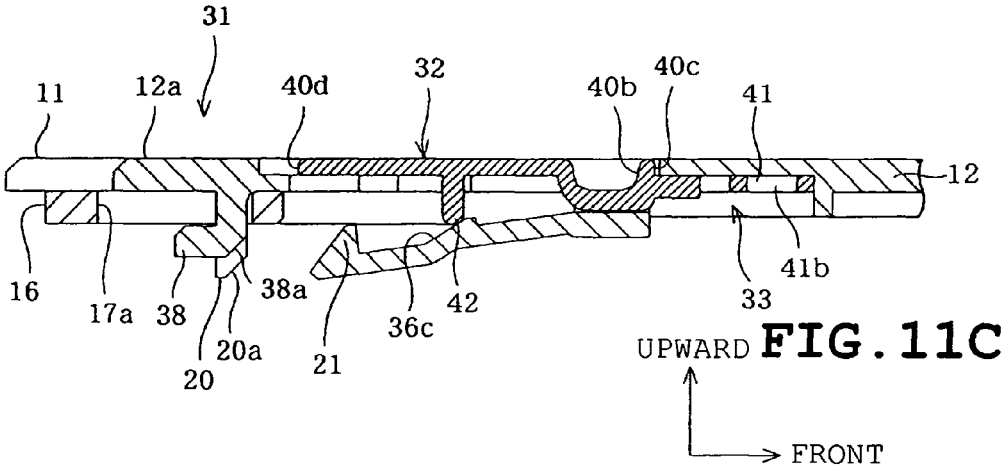

The second needle plate 12 as shown in FIGS. 2, 3 and 11A is held in an attached state by the engagement of the above-described engagement mechanism 31. When the second needle plate 12 is to be detached from the first needle plate 11, the disengagement operating member 32 is moved frontward from the rear side, whereby the second needle plate 12 can be released from the engagement with the first needle plate 11 by the engagement mechanism 31.

More specifically, when the operator slides the finger hook 40*b* of the operation portion 40 frontward against the elastic force of the elastic deformation portion 41, the depressing portion 42 is moved together with the operation portion 40 to the front position side thereby to be brought into sliding contact with the inclined portion 36*c* of the engaging member 36. With the sliding contact of the depressing portion 42, the free end of the engaging member 36 is flexed against the elastic force thereof to the position where the engagement claw 21 is disengaged from the engagement hole 17*a* (see FIG. 11B). In this case, the second needle plate 12 is released from the engagement with the first needle plate by the engagement mechanism 31 thereby to be allowed to be moved frontward. Accordingly, when the second needle plate 12 is operated at the finger hook 40*b* in the aforesaid operation direction (the direction of arrow D2), the disengagement operating member 32 can be moved so as to be slid frontward together with the second needle plate 12 (see FIG. 11C). As the result of the sliding, the engagement protrusions 19*a* to 19*c* are disengaged from the engagement recesses 29*a* to 29*c* respectively and the support protrusions 30*a* and 30*b* are disengaged from the front edge of the first needle plate 11 when the second needle plate 12 is moved frontward, whereby the second needle plate 12 is detached from the first needle plate 11.

According to the above-described embodiment, the needle plate 10 includes the engagement mechanism 31 which engages the second needle plate 12 with the first needle plate 11 by sliding the second needle plate 12 rearward from the front side of the first needle plate 11. The needle plate 10 also includes the disengagement operating member 32 which is provided on the second needle plate 12 and is able to release the second needle plate 12 from the engagement with the first needle plate 11 by the engagement mechanism 31. The disengagement operating member 32 is moved frontward from the rear side of the first needle plate 11 thereby to release the engagement mechanism 31 from the engaging state.

In the above-described construction, the second needle plate 12 is slid rearward from the front side of the first needle plate 11 thereby to be engaged with the first needle plate 11. The disengagement operating member 32 is operated so as to be moved from the frontward from the rear side of the first needle plate 11 thereby to release the engagement mechanism 31 from the engaging state. More specifically, the second needle plate can easily be attached to the first needle plate 11 by the sliding operation, and moreover, in detaching the second needle plate 12, a detaching direction corresponds with an operating direction of the disengagement operating member 32. Accordingly, since the disengagement operating member 32 is slid frontward together with the second needle plate 12, the second needle plate 12 can be detached from the first needle plate 11 only by a primary operation of the disengagement operating member 32. Consequently, the second needle plate 12 can be attached to and detached from the first needle plate 11 exceedingly easily.

Furthermore, the engagement mechanism 31 includes the engagement hole 17*a* formed in the first needle plate 11 and the elastically deformable engaging member 36 having the proximal end 36*a* fixed to the second needle plate 12 and the free end with the engagement claw 21 engageable with the engagement hole 17*a*. The engagement mechanism 31 is constructed so that the claw 21 is engaged with the hole 17*a* by the elastic force of the engaging member 36. Accordingly, the elastic force of the engaging member 36 absorbs the load applied to the second needle plate 12 in the case where the second needle plate 12 is attached to and detached from the first needle plate 11. Consequently, the second needle plate 12 can be prevented from being deformed. Additionally, since the second needle plate 12 is positioned by the engagement of the claw 21 and the hole 17*a*, the second needle plate 12 can be attached to and detached from the first needle plate 11 easily and smoothly. Furthermore, since the claw 21 is provided on the free end of the engaging member 36, the construction of the engaging mechanism 31 can be simplified.

The disengagement operating member 32 is provided on the second needle plate 12 so as to be movable between the front position and the rear position. The operating member 32 includes the operation portion 40 operated by the operator's finger, the elastic deformation portion 41 which elastically urges the operation member 40 to the rear position and is elastically deformed with the movement of the operation member 40 to the front position, and the depressing portion 42 which depresses the inclined portion 36*c* against the elastic force of the engaging member 36 with the movement of the operation portion 40 to the front position, so that the engagement claw 21 is disengaged from the engagement hole 17*a*. In this construction, the elastic deformation portion 41 of the operating member 32 is elastically deformed with the frontward movement of the operation portion 40 with operator's finger, and the engagement of the first and second needle plates 11 and 12 by the engaging mechanism 31 is canceled by the depressed portion 42. More specifically, although the operating member 32 has such a simple construction as to comprise the operation portion 40, the elastic deformation portion 41 and the depressing portion 42, the engagement by the engaging mechanism 31 is canceled only by sliding the operation portion 40 with operator's finger, whereupon the second needle plate 12 can be detached from the first needle plate 11. Additionally, a desired operability can be achieved by suitably setting the elastic force of each of the elastic deformation portion 41 and the engaging member 36.

The operation portion 40 is made so that the upper surface 40*a* thereof becomes coplanar with the upper surface 12*a* of the second needle plate 12. Accordingly, the workpiece cloth can be prevented from being caught by the operation portion 40 on the needle plate 10 in execution of sewing, and thus, the operation portion 40 does not interrupt sewing. Consequently, the needle plate 10 can be rendered suitable for practical use.

The foregoing embodiment is not restrictive but may be modified or expanded as follows. The needle plate 10 may be applied to various types of sewing machines provided with a horizontal hook mechanism inside the bed 1 as well as the above-described household sewing machine M. Furthermore, the upper surface 40*a* of the operation portion 40 may be located lower than the upper surface 12*a* of the second needle plate 12. In this case, too, the operation portion 40 does not protrude upward from the second needle plate 12. As a result, the workpiece cloth can be prevented from being caught by the operation portion 40 on the needle plate 10 in execution of sewing, and thus, the operation portion 40 does not interrupt sewing. Additionally, the second needle plate 12 may be made of a metal.

The foregoing description and drawings are merely illustrative and are not to be construed in a limiting sense. Various changes and modifications will become apparent to those of ordinary skill in the art. All such changes and modifications are seen to fall within the scope as defined by the appended claims.

What is claimed is:

1. A needle plate disposed on an upper surface of a sewing machine bed of a sewing machine having a horizontal hook mechanism inside the sewing machine bed, the needle plate comprising:

a first needle plate fixed to the sewing machine bed and formed with a needle hole through which a needle is configured to pass and a rectangular hole through which a feed dog that is configured to feed a workpiece cloth appears;

a second needle plate disposed in front of the first needle plate and above the horizontal hook mechanism, the second needle plate being detachably attached to the first needle plate;

an engagement mechanism sliding the second needle plate rearward from a front side of the first needle plate, thereby engaging the second needle plate with the first needle plate; and a disengagement operating member provided on the second needle plate, the disengagement operating member being configured to cancel the engagement by the engagement mechanism, the disengagement operating member being moved frontward from a rear side of the first needle plate thereby to cancel the engagement by the engagement mechanism, wherein the engagement mechanism includes:

an engagement hole formed in the first needle plate, and an elastically deformable engaging member having a proximal end fixed to the second needle plate and a free end formed with an engagement claw engageable with the engagement hole, and the engagement hole and the engagement claw are engaged with each other by an elastic force of the engaging member.

2. The needle plate according to claim 1, wherein the disengagement operating member includes:

an operating portion which is provided on the second needle plate so as to be movable between a front position and a rear position, the operating portion being configured to be operated with an operator's finger;

an elastic deformable portion which elastically urges the operating portion to the rear position and is elastically deformed with movement of the operating member to the front position; and a depressing portion which depresses the engagement claw against an elastic force of the engaging member with the movement of the operating portion to the front position, thereby disengaging the engagement claw from the engagement hole.

3. The needle plate according to claim 2, wherein the operating portion and the second needle plate have upper surfaces respectively, and the upper surface of the operating portion is coplanar with or is located lower than the upper surface of the second needle plate.

4. A sewing machine which includes a sewing machine bed, a horizontal hook mechanism provided inside the sewing machine bed and a needle plate disposed on an upper surface of the sewing machine bed, the needle plate comprising:

a first needle plate fixed to the sewing machine bed and formed with a needle hole through which a needle is configured to pass and a rectangular hole through which a feed dog that is configured to feed a workpiece cloth appears;

a second needle plate disposed in front of the first needle plate and above the horizontal hook mechanism, the second needle plate being detachably attached to the first needle plate;

an engagement mechanism sliding the second needle plate rearward from a front side of the first needle plate, thereby engaging the second needle plate with the first needle plate; and a disengagement operating member provided on the second needle plate, the disengagement operating member being configured to cancel the engagement by the engagement mechanism, the disengagement operating member being moved frontward from a rear side of the first needle plate thereby to disengage the second needle plate from the first needle plate, wherein the engagement mechanism includes:

an engagement hole formed in the first needle plate, and an elastically deformable engaging member having a proximal end fixed to the second needle plate and a free end formed with an engagement claw engageable with the engagement hole, and the engagement hole and the engagement claw are engaged with each other by an elastic force of the engaging member.

* * * * *